US012257523B2

(12) United States Patent
Landi, Jr. et al.

(10) Patent No.: US 12,257,523 B2
(45) Date of Patent: Mar. 25, 2025

(54) LAUNCHING DEVICE

(71) Applicant: NSI INTERNATIONAL, INC., New York, NY (US)

(72) Inventors: Frank J. Landi, Jr., New York, NY (US); Steve Rehkemper, Chicago, IL (US); Jeffrey Rehkemper, Chicago, IL (US); Adam Gelder, Oak Lawn, IL (US); Kamil Maj, Chicago, IL (US)

(73) Assignee: NSI INTERNATIONAL, INC., New York, NY (US)

( * ) Notice: Subject to any disclaimer, the term of this patent is extended or adjusted under 35 U.S.C. 154(b) by 0 days.

(21) Appl. No.: 17/865,321

(22) Filed: Jul. 14, 2022

(65) Prior Publication Data

US 2023/0201734 A1 Jun. 29, 2023

Related U.S. Application Data

(60) Provisional application No. 63/223,020, filed on Jul. 18, 2021.

(51) Int. Cl.

| | |
|---|---|
| ***A63H 27/14*** | (2006.01) |
| ***A63B 69/40*** | (2006.01) |
| ***A63H 29/16*** | (2006.01) |

(52) U.S. Cl.

CPC ..... *A63H 27/14* (2013.01); *A63B 69/409* (2013.01); *A63H 29/16* (2013.01)

(58) Field of Classification Search

CPC ..... A63H 27/14; A63H 29/16; A63B 69/40; A63B 69/409; A63B 2069/402

See application file for complete search history.

(56) References Cited

U.S. PATENT DOCUMENTS

| | | | | |
|---|---|---|---|---|
| 5,819,717 | A * | 10/1998 | Johnson | F41B 11/681 124/66 |
| 5,839,940 | A * | 11/1998 | Ensmenger | A63H 27/14 446/212 |
| 6,006,517 | A | 12/1999 | Kownacki et al. | |
| 9,700,779 | B1 * | 7/2017 | Leal | F41B 11/80 |
| 2005/0103318 | A1 * | 5/2005 | Leal | A63B 69/409 124/74 |
| 2009/0013983 | A1 * | 1/2009 | Polk, III | A63H 27/14 124/6 |
| 2017/0340943 | A1 * | 11/2017 | Pierotti | A63B 24/0087 |

FOREIGN PATENT DOCUMENTS

KR 20160003434 A * 1/2016

OTHER PUBLICATIONS

Translation KR20160003434A (Year: 2016).*

* cited by examiner

*Primary Examiner* — Eugene L Kim
*Assistant Examiner* — Alyssa M Hylinski
(74) *Attorney, Agent, or Firm* — Andrew F. Young, ESQ.; NOLTE LACKENBACH SIEGEL

(57) ABSTRACT

A launching device, system and method uses a fluid pressure system and a launch direction system in combination with an automated control system and a fluid cavity in a game ball for compressed air providing a pneumatically operated toy that releases upon a user-directed and automated control launch of a game ball.

1 Claim, 17 Drawing Sheets

LAUNCHING DEVICE

CROSS REFERENCE TO RELATED APPLICATIONS

This application relates to, U.S. Design Ser. No. 29/799,845 filed Jul. 16, 2021, the entire contents of which are incorporated herein by reference including the figures.

This application relates to, and claims priority from U.S. Provisional Ser. No. 63/223,020 filed Jul. 18, 2021, the entire contents of which are incorporated herein by reference.

FIGURE SELECTED FOR PUBLICATION

FIG. 1

BACKGROUND OF THE INVENTION

Field of the Invention

The present invention relates to a manual pneumatic launching device for a toy ball that securely imparts a launching energy and rotational force on a ball with alternative play modes, different pneumatic pressures, automotive locking retention, and with audio feedback guidance and intended passing zone delivery. More particularly the present invention relates to a launching, device, system and method using a fluid pressure engine and a launch direction system for use with pneumatically operated toys such as balls that include a fluid input cavity which is in continuous fluid communication with a source of compressed air.

Description of the Related Art

There are professional ball launching devices used in the sporting industries of baseball and football that operate on powerful electrical motors, and possibly combustion engines, that operate will full size footballs and use spinning traction wheels to impart both a rotational angular vector and launch vector on a full size launched ball. Unfortunately, these devices are unwieldy and expensive.

Known in the art is a pneumatic engine for a toy as shown in U.S. Pat. No. 6,006,517, the entire contents of which are incorporated herein to the extent they are consistent with this disclosure and excluded to the extent they are not. U.S. Pat. No. 6,006,517 provides a fluid engine for use in pneumatically operated toys such as wheeled vehicles or planes where reciprocal driving movement is needed (such as to drive a propeller or rotate wheels). As disclosed therein, there s a valve rod that is movably housed with a spring to open a valve opening and close exhaust apertures during a piston's power stroke and to reverse the process in an exhaust stroke in synchronism by use of a cam integrally secured to a power shaft. Necessarily, herein is the need for a repeated reciprocal action running off the same compressed air source to drive a toy.

Also know in the art is a hand-held pump air-pressure launcher termed the LONG BOMB FOOTBALL GUN™ (not registered) (US Trademark Ser. No. 74/310,418, abandoned), provided by Cap Toys, Inc., of Cleveland, Ohio 26201 which included a manual ball retaining and ball release mechanism and a piston-pump pressure applicator wherein the launched ball included a custom-made ball, containing a foam outer layer, an inner pressure vessel for receiving a pressurized launching gas (ambient air), and a retaining lug. During use, the user held the launcher in two hands, placed a prepared football in a holding cradle, manually engaged the retaining lug, filled the presser reservoir by pumping, manually aimed the device and manually released the retaining lug thus launching the retained ball. Unfortunately, this device was awkward during use and difficult to operate repeatedly with success.

ASPECTS AND SUMMARY OF THE INVENTION

According to at least one alternative and adaptive aspect of the present invention, there is provided a manual pneumatic launching device with automated launching control for a toy ball that securely imparts a launching energy and rotational force on a ball with alternative play modes, different pneumatic pressures, automotive locking retention, and with audio feedback guidance and intended passing zone delivery.

According to another alternative and adaptive aspect of the present invention, there is provided a launching, device, system and method using a fluid pressure system and a launch direction system in combination with an automated control system for use with pneumatically operated toys such as balls that include a fluid input cavity which is in continuous fluid communication with a source of compressed air and releases upon a user-directed instruction.

According to another alternative and adaptive aspect of the present invention, there is provided a launching device, system and method using a fluid pressure system and a launch direction system in combination with an automated control system and a fluid cavity in a game ball for compressed air providing a pneumatically operated toy that releases upon a user-directed and automated control.

According to one further aspect of the present invention, there is provided a launching device, for a pneumatic toy ball, comprising: a fluid pressure control system with a one-time use pneumatic launch engine; a rechargeable inflatable compressed air canister in a toy device having a normally open mouth thereof; said normally open mouth of said air canister including at least one inwardly projecting member; an intake manifold of said one-time pneumatic launch engine; said intake manifold comprising an air outlet for complementally receiving and releasing said open mouth of said compressed air canister during a use; an external air inlet having a one-way check valve for permitting external air pressurization of said compressed air canister during said use and selectable external air re-pressurization of said compressed air canister during a re-use thereof; an automated launching control system; a receiving bayonet member on said air outlet for slidably and guidably receiving said intake manifold of said compressed air canister thereon in said launch engine; said bayonet member including a central opening for transmission of said external air pressurization into said compressed air canister during said use; said bayonet member including an outer surface having a guiding spiral groove thereon for slidably and guidably receiving said projecting member and inducing a spiral rotation of said compressed air canister during a launch thereof; a movable lock retaining member engaging said open mouth of said compressed air canister during a pressurization of said air canister; a lock retaining and releasing system for operating said lock retaining member between a lock and an unlock position during said use; a launch direction system with motor control moving of said bayonet member through a series of vertical and traversal steps retained in a permanent memory of a control board selected by a user prior to a release of said lock retaining member by said lock retaining and releasing system.

The above and other aspects, features and advantages of the present invention will become apparent from the following description read in conjunction with the accompanying drawings and illustrations, in which like reference numerals designate the same elements.

DETAILED DESCRIPTION OF THE PREFERRED EMBODIMENTS

Figure 1:
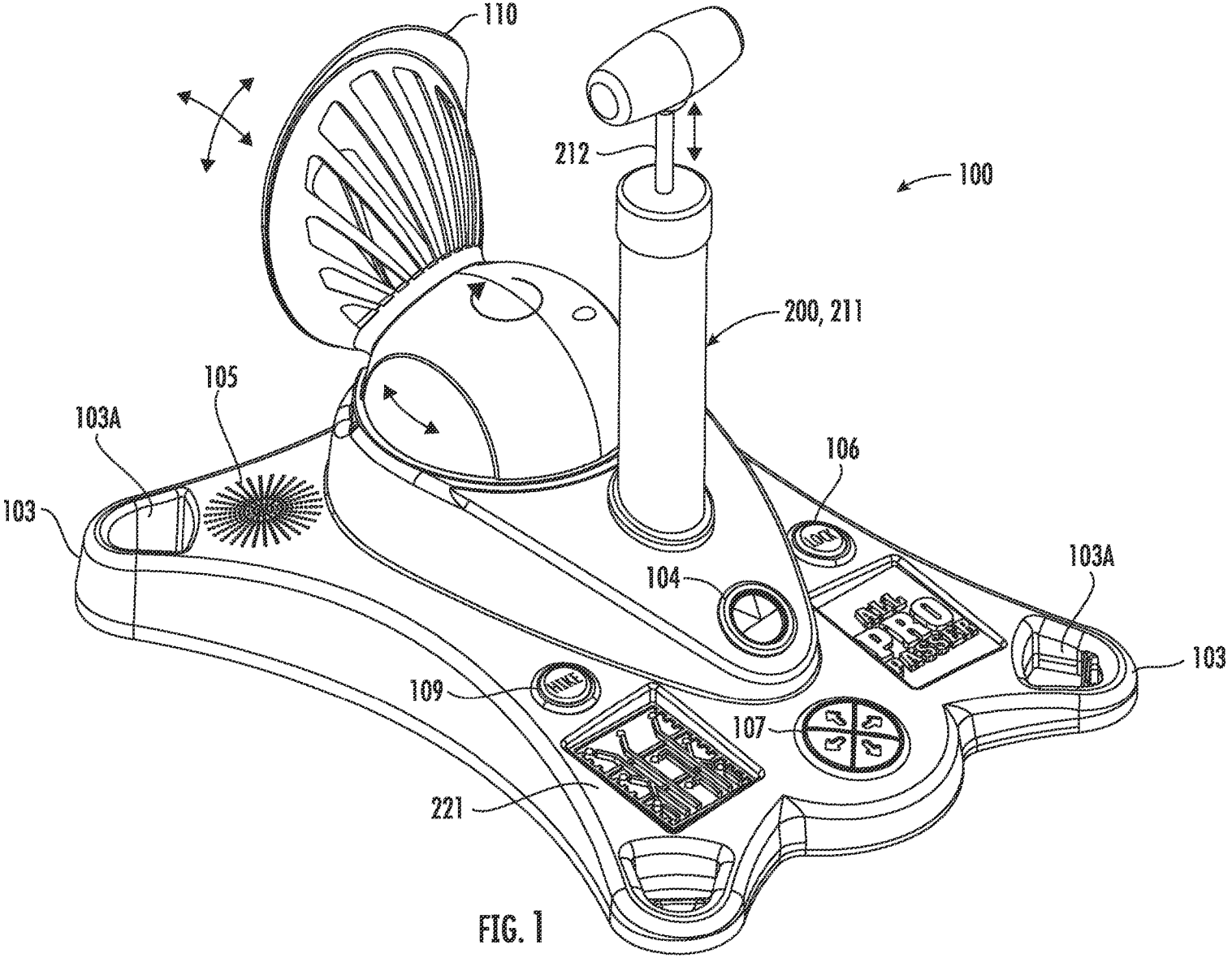
FIG. 1 is a top perspective view of one alternative aspect of an assembled launching device according to the present invention.
Figure 2:
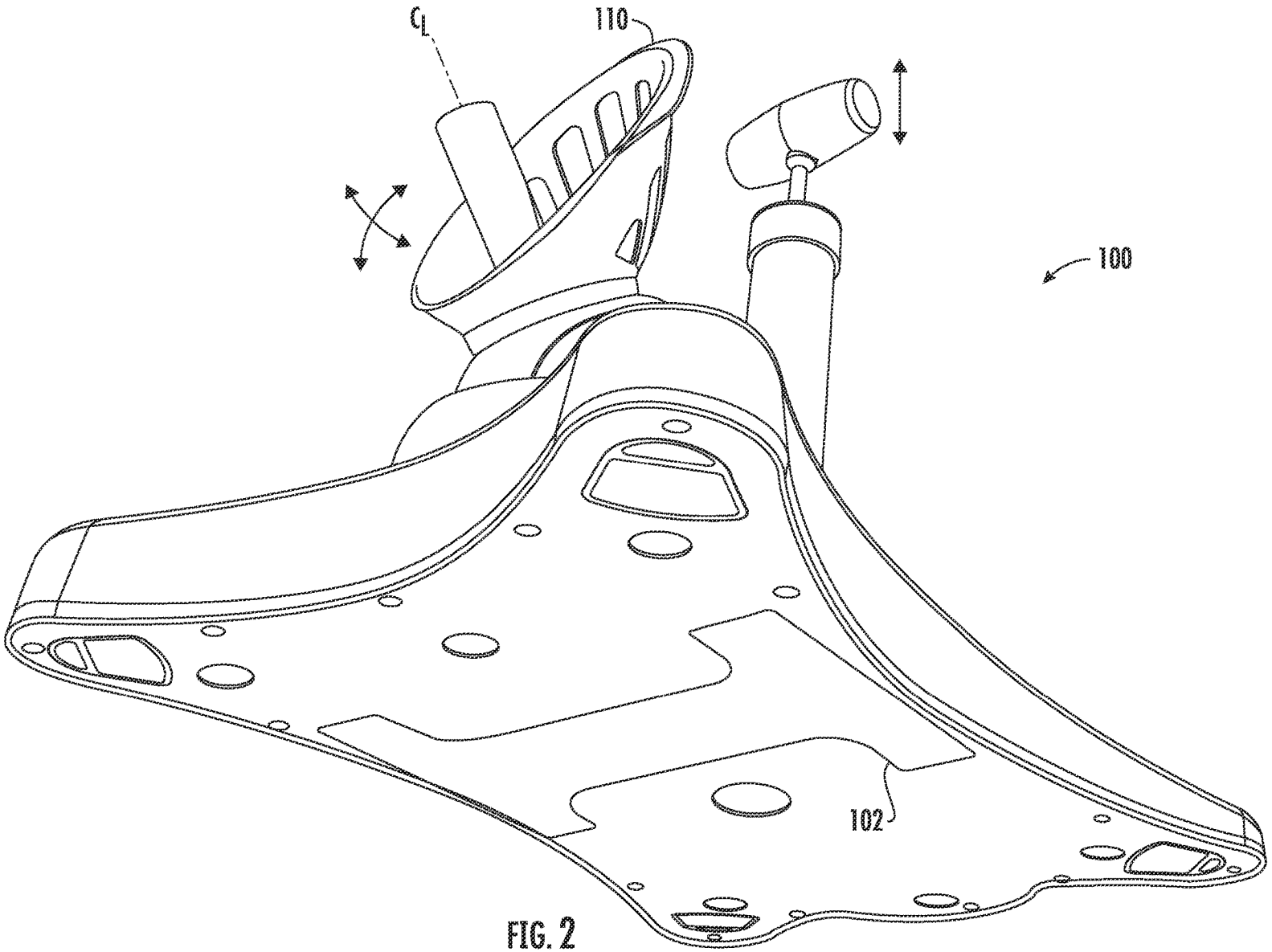
FIG. 2 is a bottom perspective view of FIG. 1.
Figure 3:
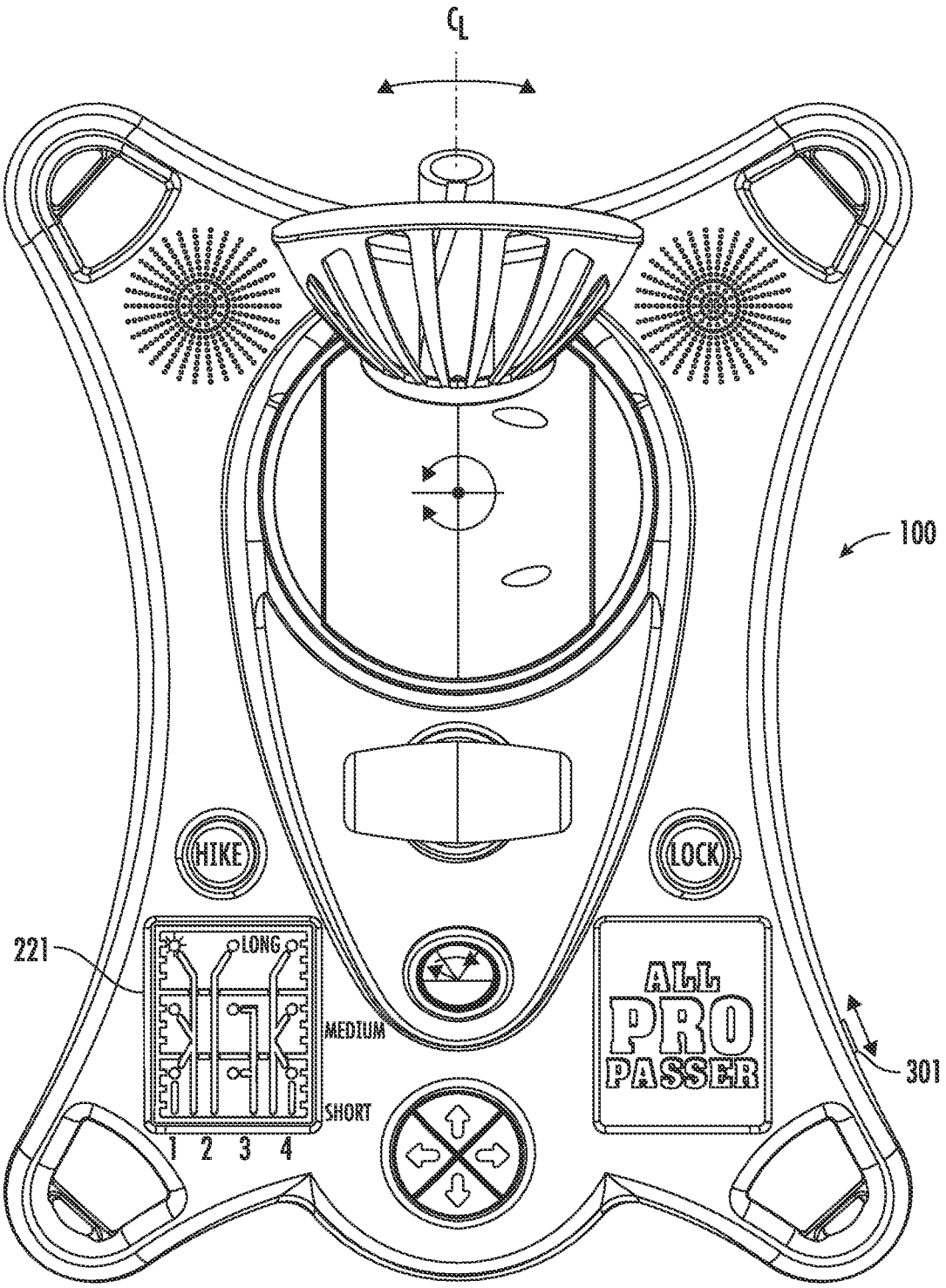
FIG. 3 is a top plan view of the alternative aspect of an assembled launching device in FIG. 1.
Figure 4:
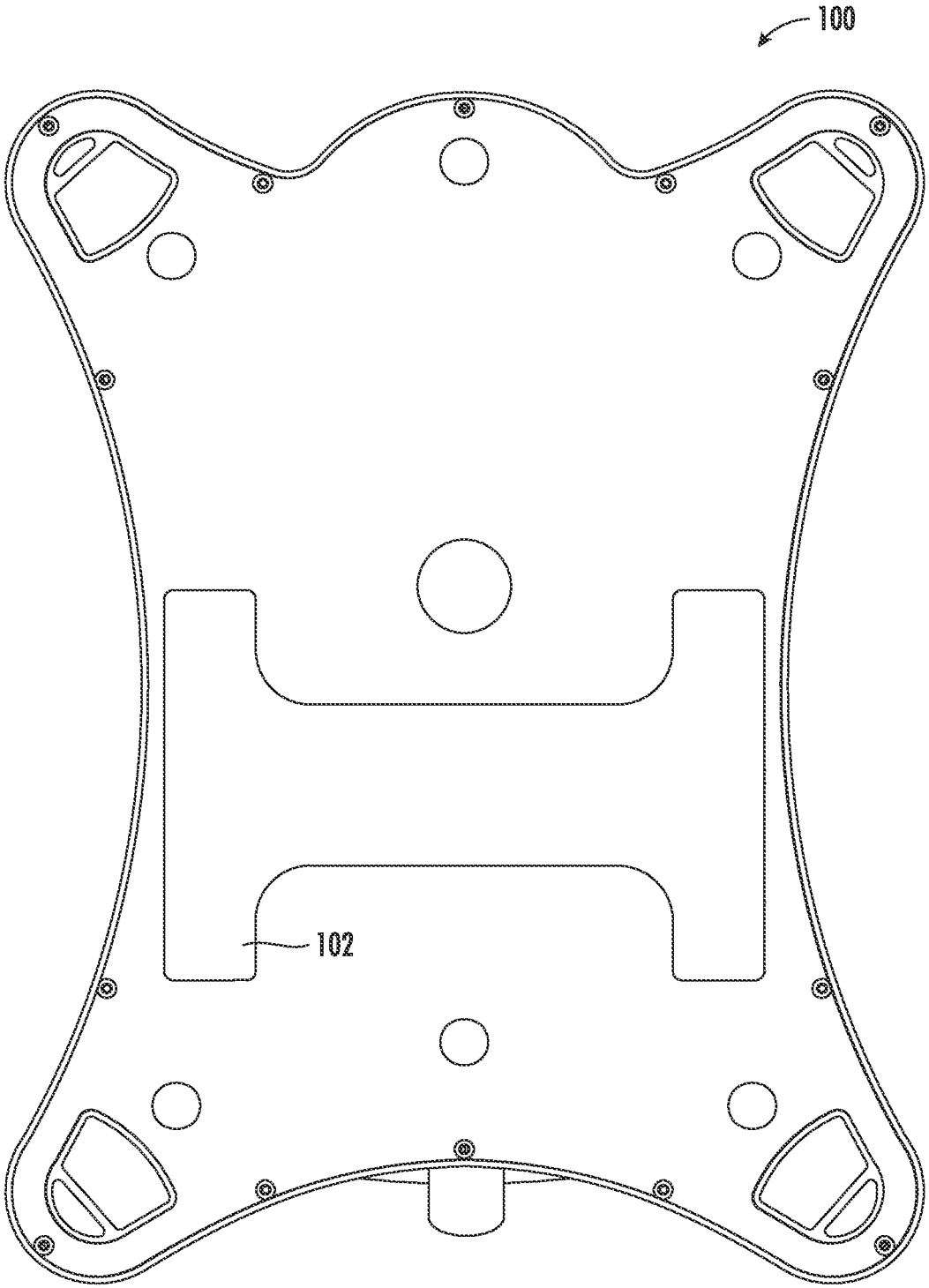
FIG. 4 is a bottom plan view thereof.
Figure 5:
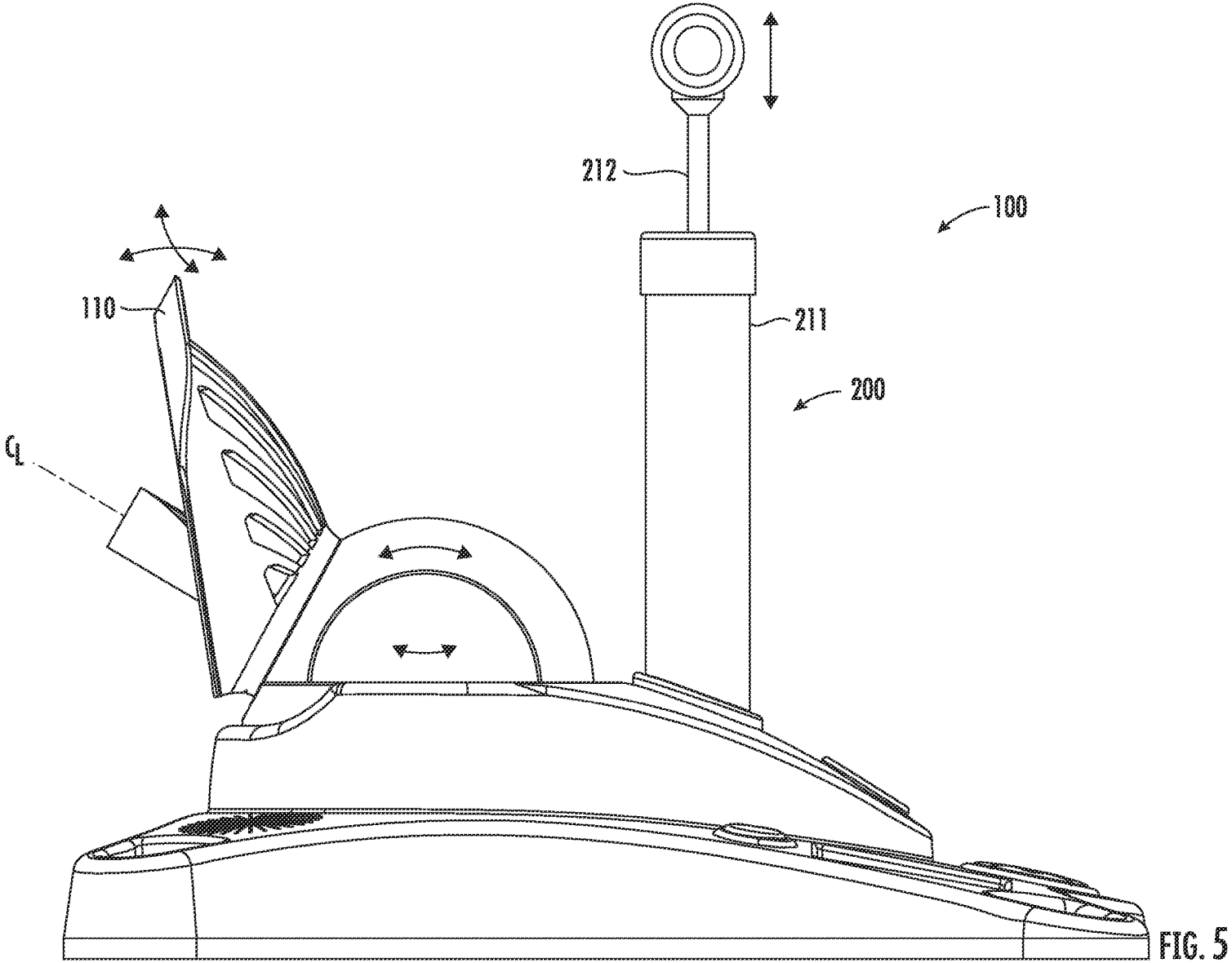
FIG. 5 is a left side elevation view thereof noting the motion and operational directions optionally available during a use.
Figure 6:
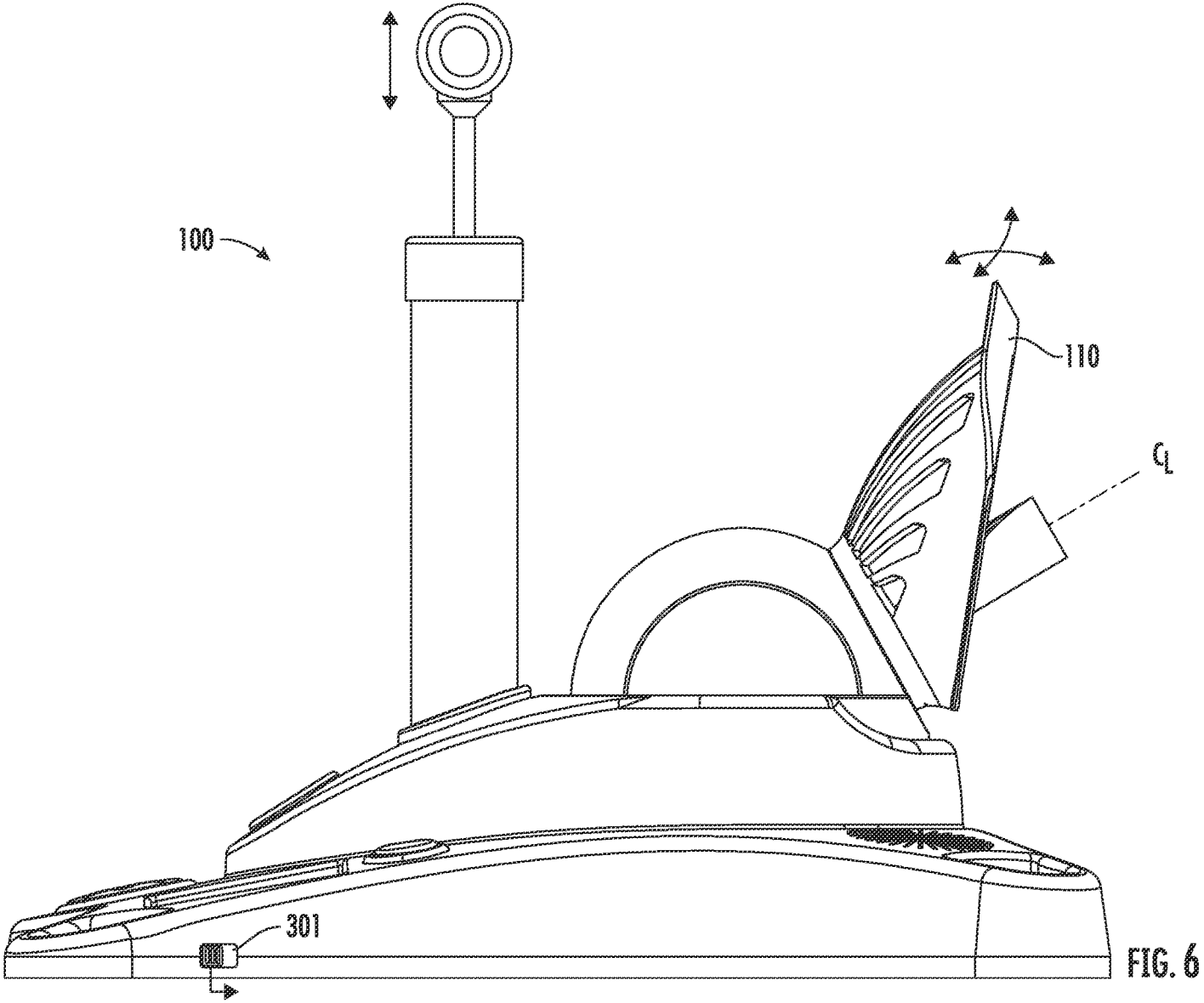
FIG. 6 is a right side elevation view of FIG. 5.
Figure 7:
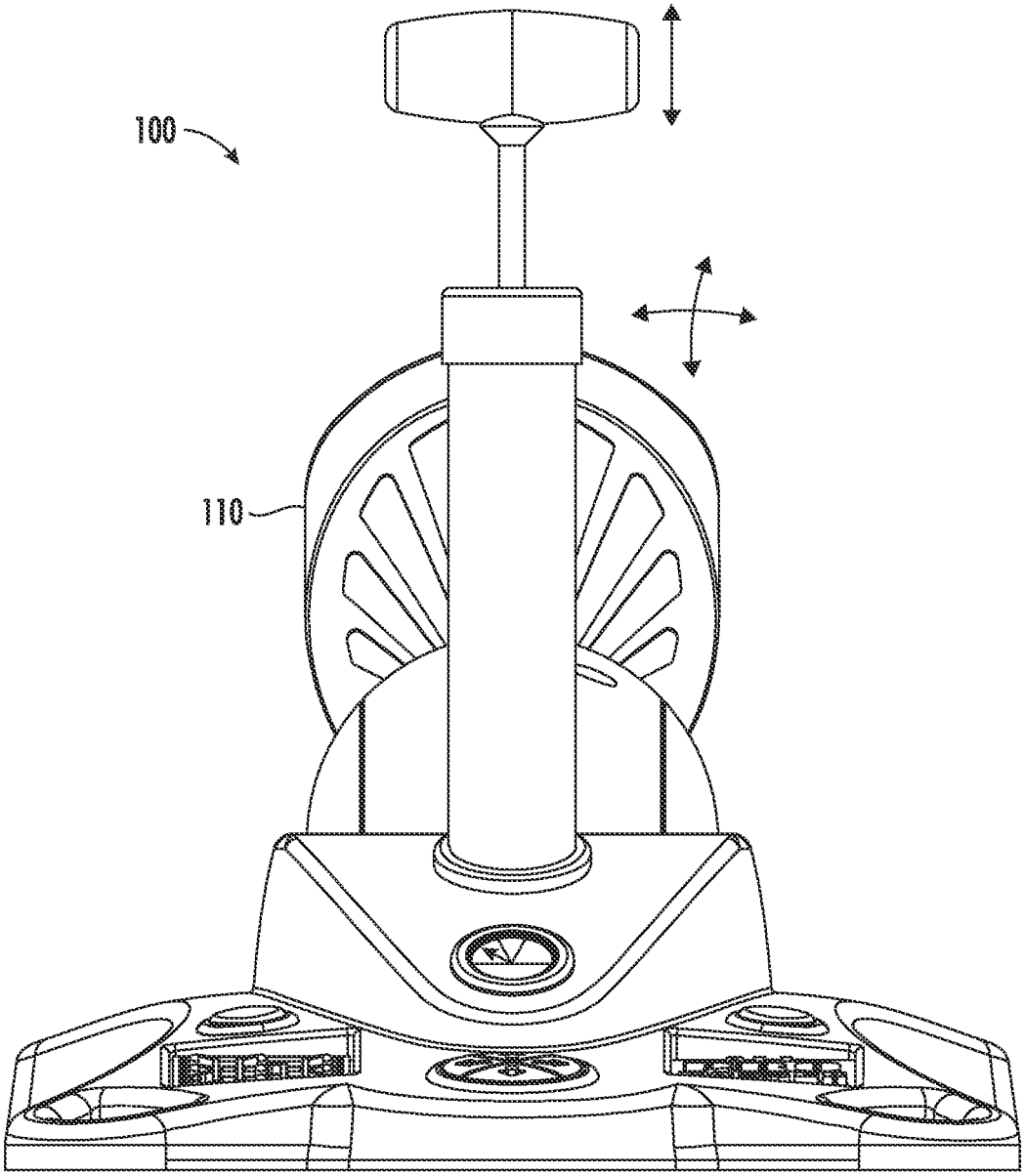
FIG. 7 is a rear elevation view of FIG. 1.
Figure 8:
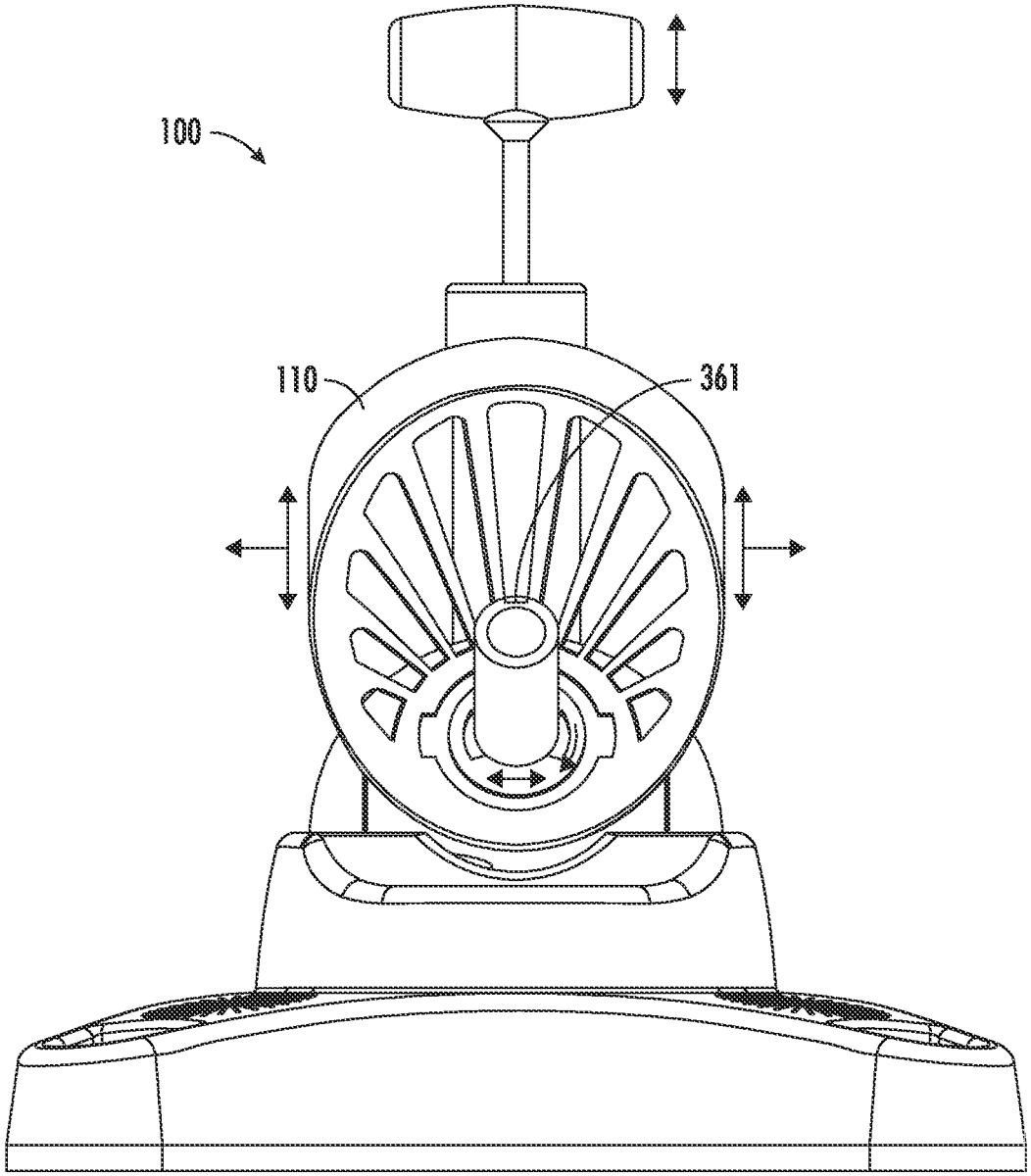
FIG. 8 is a front elevation view of FIG. 1.
Figure 9:
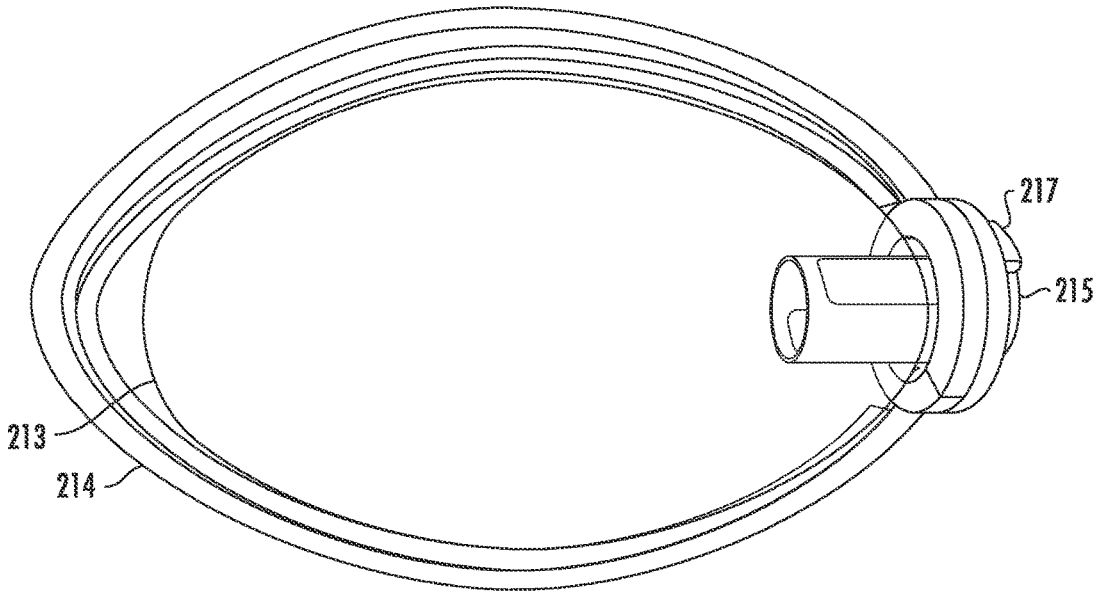
FIG. 9 is a partial sectional view of a toy ball containing a rechargeable compressed air canister and normally open mouth for mounting.
Figure 10:
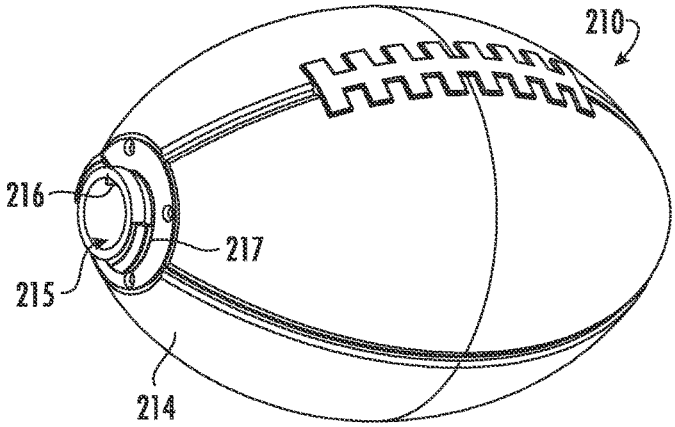
FIG. 10 is a perspective view of an assembled toy ball noting the normally open mouth and retaining lugs for secure engagement during a locking use.
Figure 11:
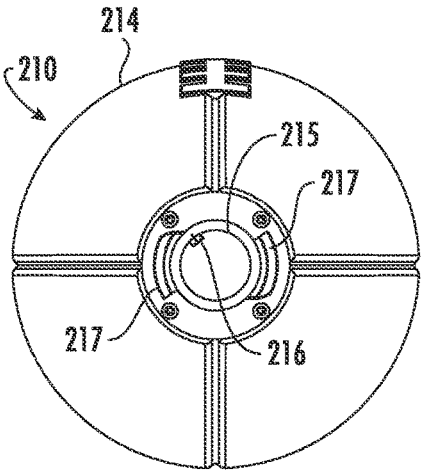
FIG. 11 is a rear-elevation view of the toy ball in FIG. 10 showing the open mouth for the air canister and dual retaining lugs thereon.
Figure 12:
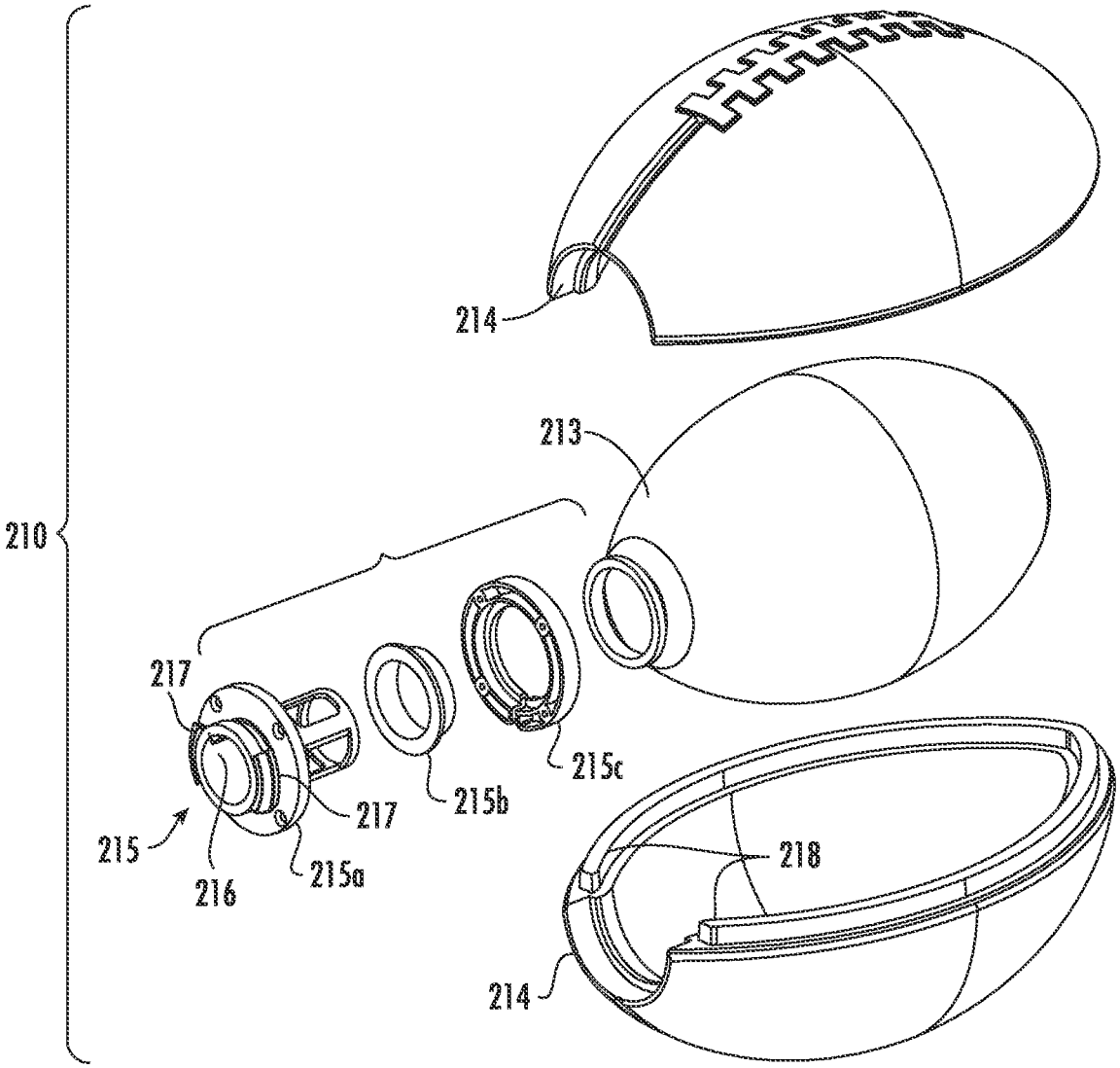
FIG. 12 is an exploded perspective view of an assembled ball noting the inner compressed air canister therein and outer foam grip surface for easy game play.
Figure 13:
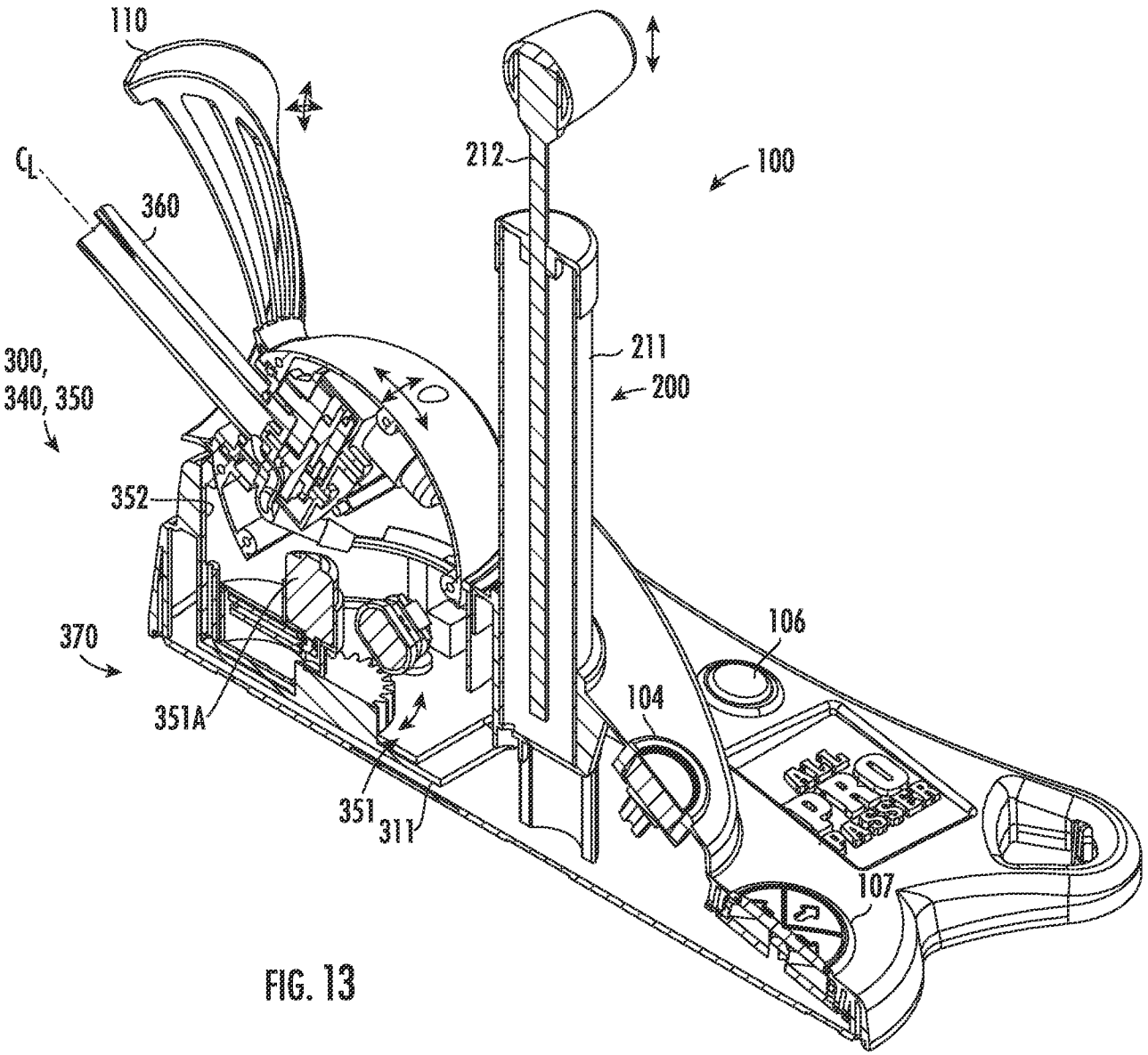
FIG. 13 is a length-direction sectional view of FIG. 5 noting the internal components.
Figure 14:
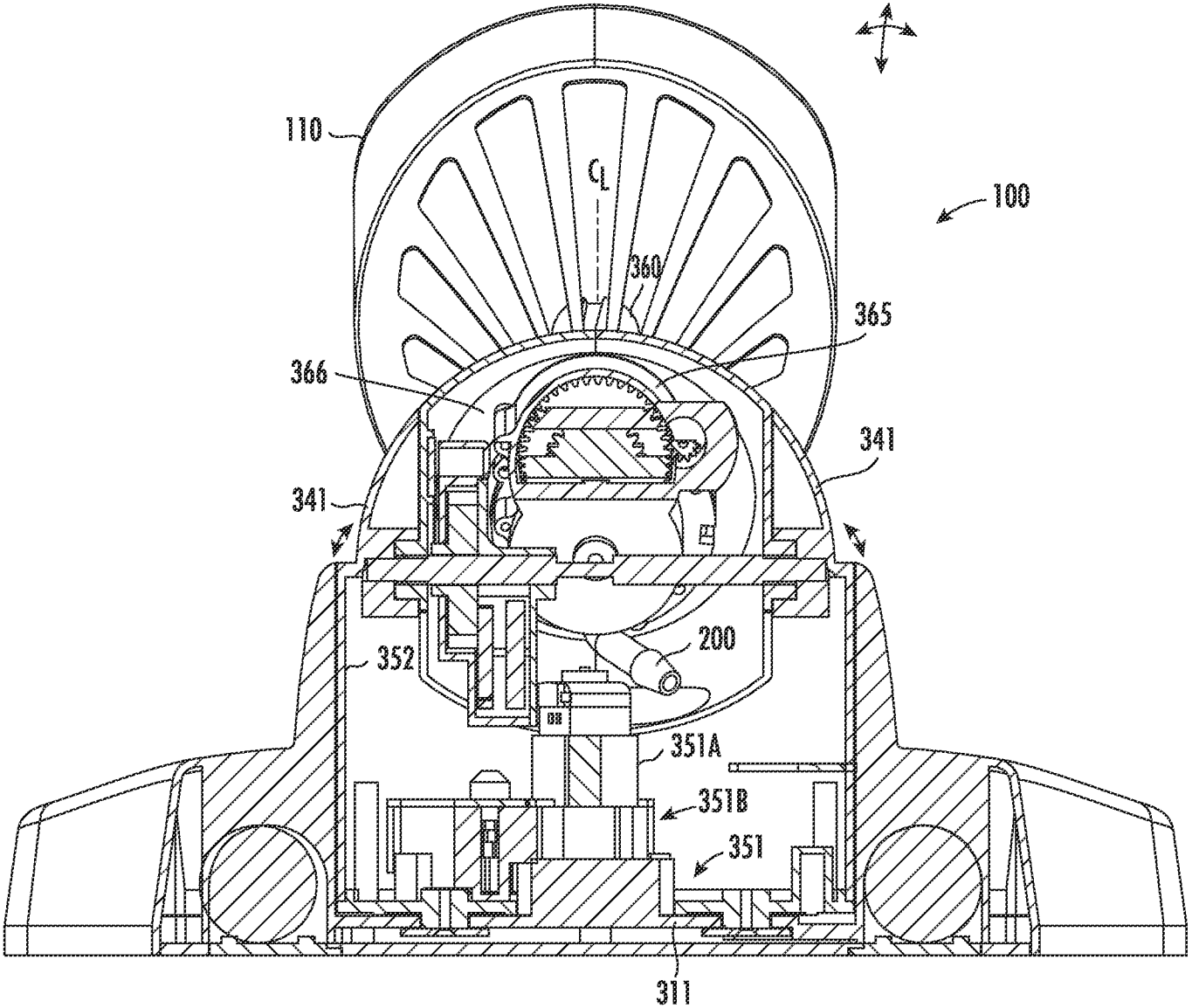
FIG. 14 is a cross-direction sectional view of FIG. 7 noting the internal components.
Figure 15:
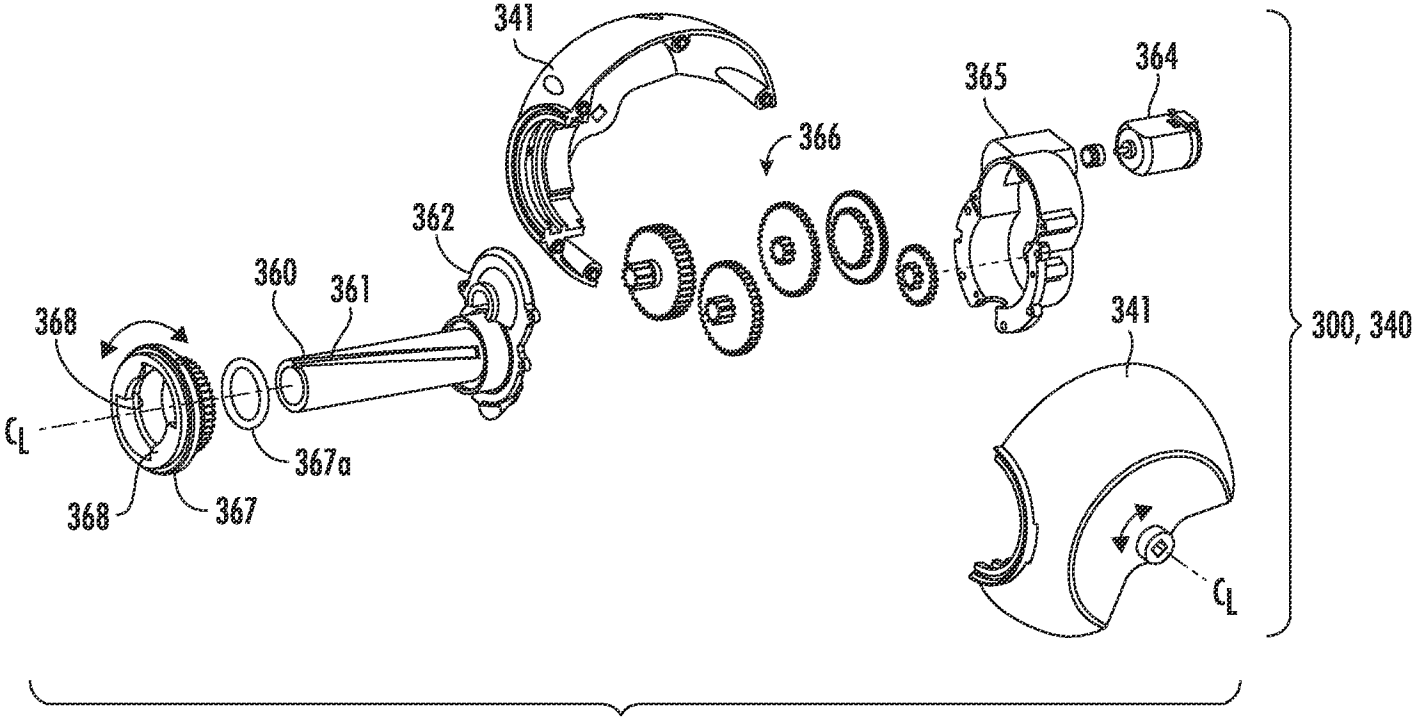
FIG. 15 is an exploded perspective view of an automated launch direction system including release system for lockably retaining during pressurization and releasing of the retaining lugs on the open mouth of the compressed air canister during a launch use.
Figure 16:
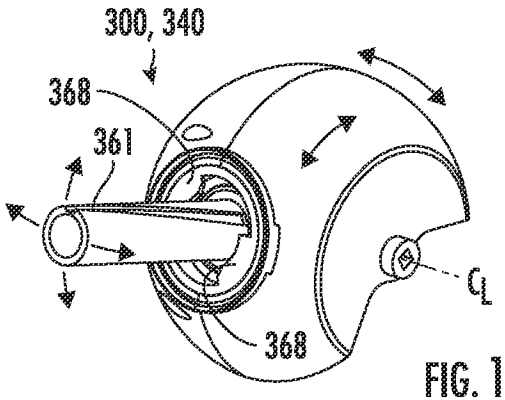
FIG. 16 is an assembled perspective view of the automated launch direction system of FIG. 15.
Figure 17:
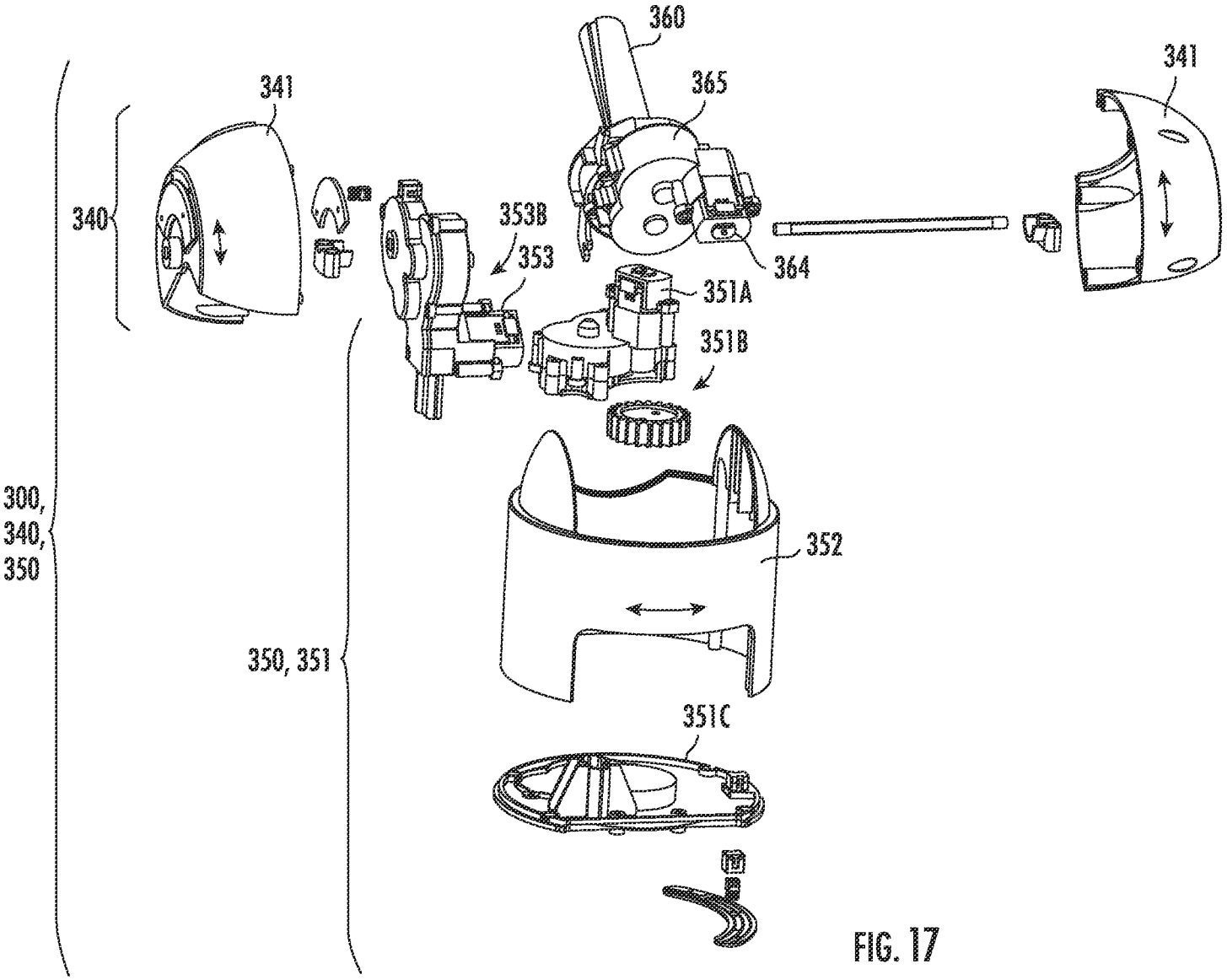
FIG. 17 is an exploded perspective view of the automated launch direction system including FIG. 16 components and a pivot traverse system.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Referring now, collectively, to the alternative and adoptive element noted in FIGS. 1 through 19B, a launching device and system 100 using a pressurized fluid launch engine with a fluid input and a source of compressed air (referred to herein as the fluid).

Launching device and system 100 provides the structure and elements for providing a method for launching a toy 210, shown here in a nonlimiting example, as a toy ball 210, using pressurized air as a fluid medium in a pre-launch programmable and selectable manner to assist individual or group toy-play.

Launching device and system 100 includes a fluid pressure control system 200 for operating and dispensing a fluid input (compressed air) and an automated launch direction control system 300 which retains releases toy ball 210 upon one of a plurality of user-selected automated launch sequences based upon a user input.

Launching device and system 100 includes a base housing 101, having an outer base with battery access opening 102 for securely storing batteries to power launching device and system 100. Four outer leg extensions 103 includes respective openings 103A for stakes (not shown) to secure device 100 to a turf game field.

A pressure gauge 104 is provided to reflect the stored pressure in the compressed air canister and which is in fluid communication with pump 211, having a pump engagement base 211*a* and the inflation and release system as shown. One or more speakers 105 in speaker housings 105*a* are provided in communication with a control board 306 for providing pre-recorded sound announcements, such as 'hike' and 'go long' and 'ready' as well as sound indicators of several musical notes related to pre-programed movements of the automated control launching system 300 upon the triggering of launching device 100.

A lock trigger button 106 on the top of base housing 101 triggers an automated lock/unlock motor controller as will be discussed in automated control launch system 300 so as to releasably engage (at a beginning of a pressurized step) the open mouth of the compressed air canister in the ball 210.

Fluid pressure control system 200 includes a pump 211 including an external air inlet and a one-way air check valve outlet 211A and a pump handle 212 for reciprocal motion to draw air into fluid pressure control system 200 and (via the one-way check valve) pressurizing air into a cavity for compressed air 213 in ball 210. Ball 210 includes an outer protective foam cover 214 and an open mouth 215 having an inwardly projecting member 216 of the compressed air canister 213. Open mouth 215 includes securing components (see FIG. 12) securing an outer access ring 215*a* with an inwardly projecting securing lug (as shown) and one or more outer rigid locking members 217 in a fixed position on the open mouth 215. Middle support ring 215*h* engages with a compression ring 215*c* to compress and secure the open mouth 215 to the cavity for compressed air 213 in a unified and secure matter. Following this, during assembly, the outer foam protective cover 214 is attached by adhesive using receiving grooves 218 to ensure alignment.

Figure 18:
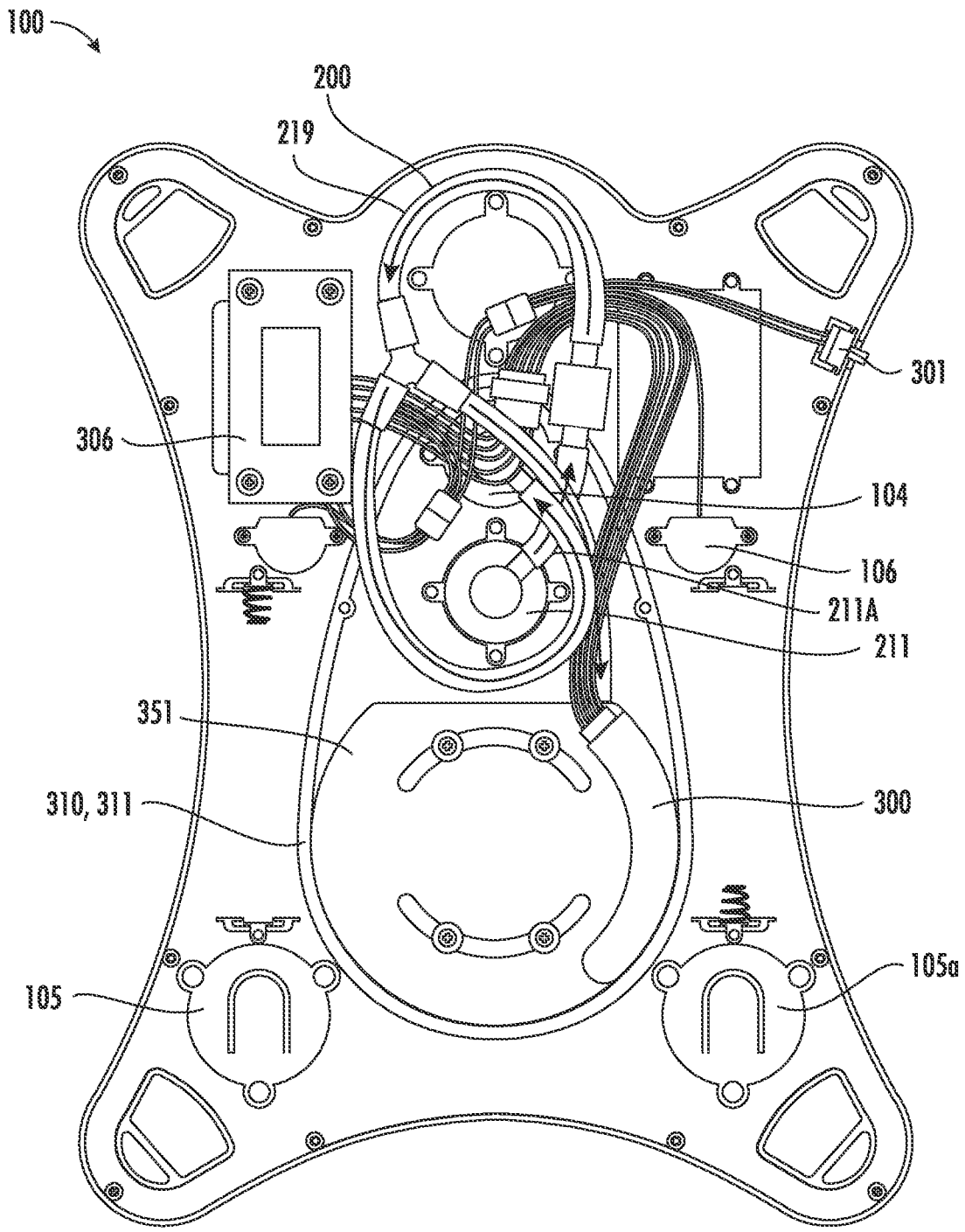
FIG. 18 is a bottom inner systems view of the launching device and system noting positions of elements within the outer body.
Figure 19A:
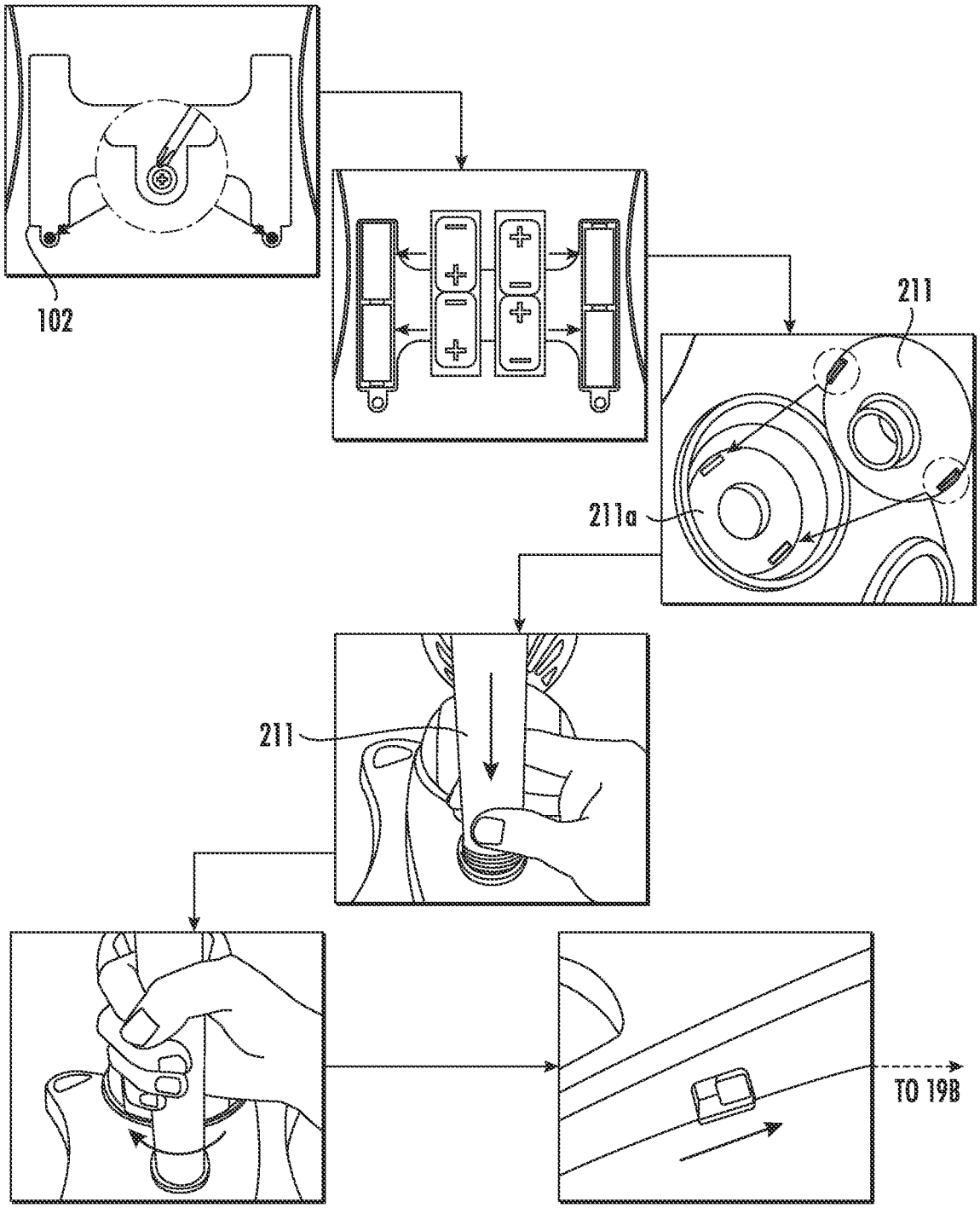
FIGS. 19A, 19B depict an illustrated assembly and launch and replay method of use according to the present invention.
Figure 19B:
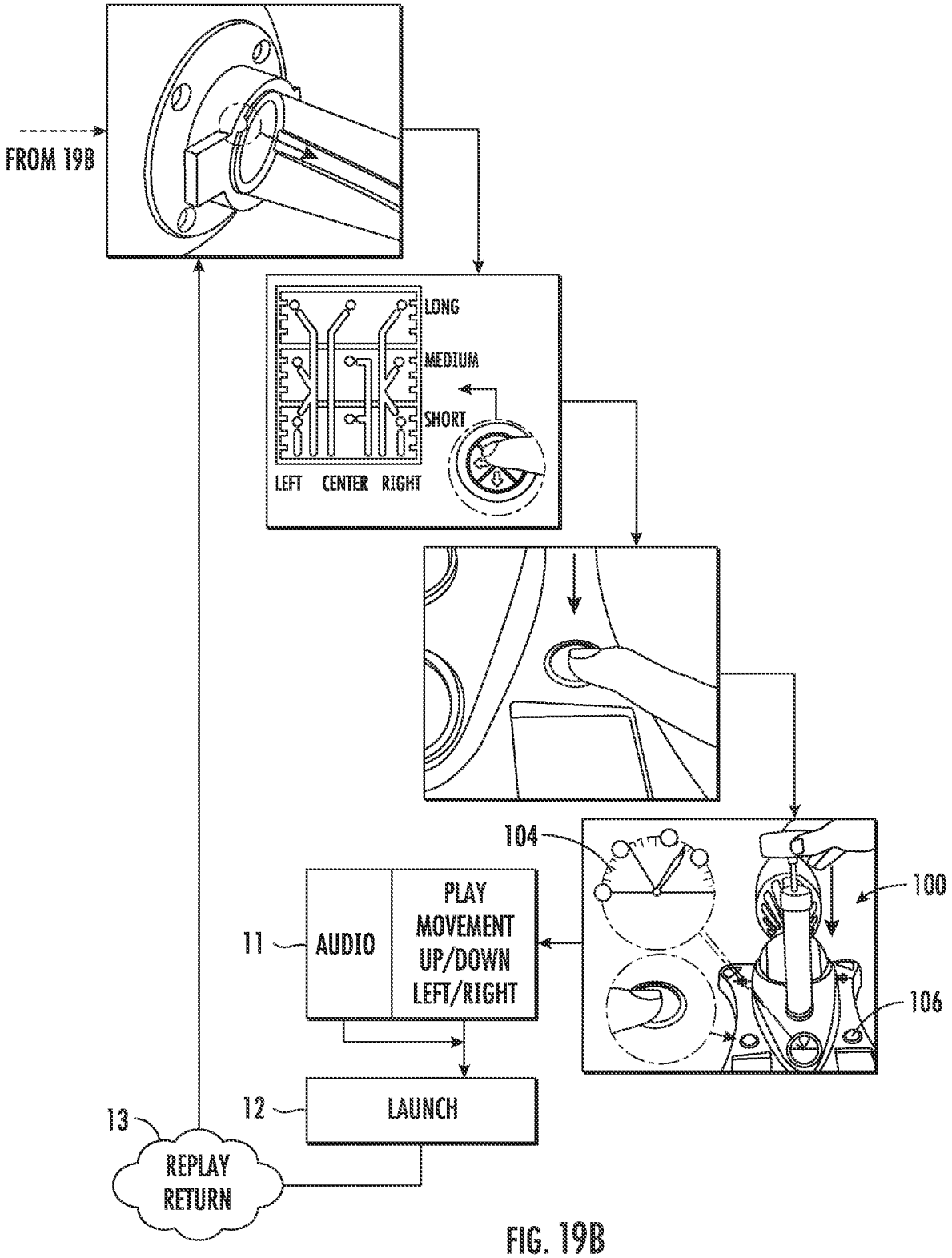

As is noted in reference combination to FIGS. 1 and 18, as pump handle 212 is raised, an internal one-way check valve opens to draw in ambient air and as pump handle is depressed, the one-way check valve closes and compressed fluid (air) is injected via a pneumatic tube 219 and reaches pressure gauge 104 via a Y-fitting and thereafter reaches and is transmitted to the cavity for containing compressed air 213 and is sored therein. As pump handle 212 is next-extended reciprocally, more air is drawn in, the one-way check valve functions and air pressure builds as the pump 200 is operated to build appropriate pressure based on the gauge 104 (short-pass length 25 psi, medium-pass-length 35 psi, long-pass-length 45 psi (maximum) as will be understood by those of skill in this art).

A protective basket 110 is provided at the end of the bayonet member of the automated control launching system 300 so as to provide initial guidance (pivot and traverse) to ball 210 during a launch sequence and during movement into a desired passing zone position (left, right, up, down) and distances (short, medium, long) noted on 'passing zone display' 221 as will be discussed.

The automated launch control system or automated launching direction system 300 includes a number of integrated components and systems to securely retain and then release ball 210 containing pressurized air in cavity 213, as will be discussed, these include pivot rotation assembly 340 (up-down motion) and pivot-traverse system 350 (right-left motion), upon command.

When actuated via the on/off switch 301, stable base 310 supports a rotational motor support 311 (see FIG. 18) supporting a pivot shell 352 (see FIG. 17) within and upon base housing 101 which includes a first rotation motor 351A on a traverse support 351C for pivotably (left-right) rotating pivot-rotation assembly 340 via a gearing assembly 351B, and a second rotation motor 353 via gearing assembly 353B for elevationally pivoting-indexing rotation assembly 340 so that those of skill in this art will recognize that pivot-rotation assembly 340 via an integrated launch control system 370 is controlled to pivot (left-right) and elevate (up-down) relative to base housing 101 so as to position an extending bayonet member 360 at one of three elevation points (short, medium, long) and at one of four distance traverse points (left, left-off, right-off, right) and in any other elevation points and distant points as may be provided by the programmer control board 306 during a use thereof (and in a non-limiting manner).

Pivot-rotation member 340 includes, along with pivot traverse system 350 and as shown, within the combined automated control launching system 300, an inner opening along the longitudinal length from the pneumatic tube for air 219 to the cavity for compressed air 213 in the ball 210 so as to convey fluid pressure to the ball 210 during a use. Bayonet member 360 includes an outer spiral groove 361, as shown, for sliding engagement with the member 216 provided in the open mouth 215 of ball 210 so that ball 210 will be guided to spiral upon release.

Pivot-rotation member 340 includes an outer housing 341 having two parts and which secures the base bayonet 362 in position thereon when assembled. Therein, a pressurizing-lock-release-launch motor 364 is securely received in a motor housing 365 and thorough a series of reduction gears 366 operates to engage a rotational lock-unlock member 367 relative about bayonet 360 on a sliding washer 367*a* through engagement teeth. Lock-unlock member 367 includes one or more inwardly extending engagement lugs 368, 368 which slidingly engage (and release) the respective one or more outwardly extending lock members 217 on the open mouth 215 forming an operating intake and release manifold or an operative valve lock and release system driven by the triggering of motor 364.

Control board member 306 includes a control board with any necessary elements to operate launching device and system 100 according to the methods and steps herein. Lock trigger 106 is a control step that indicates to control board member 306 which is in operative motor control of motor 364 to rotate the engagement ring lock and unlock member 367 containing engagement lugs 368, 368. In this situation, it is understood that in the fluid pressure control system 200 that ball 213 and thus the open mouth thereof 215 is positioned downwardly over the bayonet mount 360 in a sliding engagement so that respective lugs 217 are available to be slidingly engaged with lugs 368 9 which rotate thereto, and draw inwardly and seal open mouth 215 to the pivot-rotation member 340 and the bayonet mount 360 for pressurization via pump 200. This forms a closed pressurization system for storing compressed air therein (mainly within cavity for compressed air 213 but also in part within pneumatic air tube 219 which communicates from the one-way check valve in pump 200 to pressure gauge 104 and thus to the cavity 213)

The user then operates pump handle 212 and follows instructions to reach a low (25 psi), medium (35 psi), or high pressure (45 psi) reading on the pressure gauge 104.

Next, a user, selects, via a selection trigger 107 (up/down, left/right) one of the LED indicated (via indicator pass-pathway displays 221) passing zones (left, left-left, right-right, and right) and distances the pressure on the pressurized gauge 104 has reached. At that point, the user presses the start button 109 or 'hike' button 109 to begin a pre-recorded stored series of play moves by the pivot-rotation member 340 (left/right, up/down) and the pivot-traverse system 350 (left-right) ultimately ending in a position where the central axis (center line) of the bayonet 360 is positioned at the user-desired orientation, and at that time, the timing sequences triggers motor 364 to rotate (now in a reverse-locking-direction to release) the inwardly projecting lock members 368, 368. Thus, upon sufficient rotation of the outer lock ring 367 the compressed air in the compressed air cavity 213 is no longer sealingly restrained (constrained) and the ball 210 is ejected under pressure linearly while member 216 rides groove 361 causing a rotational moment to be imparted to ball 210 in transit providing greatly enhanced stability during flight so as to enhance a user-desired game play.

An adaptive series of assembly and game-playing steps alternatively incudes but is not limited to those shown additionally in FIGS. 16A to 16B (an illustrated flow process extending in Steps 1-13 from FIG. 16A to FIG. 16B, as shown). The assembly set up for the system includes the following steps but may be modified or augmented depending upon the preferences of a user.

Step 1: Unpackage the product and access the battery compartment.

Step 2: Insert batteries and close and securely fasten the battery compartment.

Step 3: Optional step to insert the bayonet movement assembly (which may be provided pre-assembled).

Steps 4-5: Insert the pump and rotate for secure engagement in a threaded installation.

Step 6: Turn on the launching device and power the internal motor.

Step 7: Slide the ball on to the launch tube of the bayonet housing assembly, and align the guide member on the inside of the football receiver with the spiral groove on the exterior of the launch tube of the bayonet housing assembly and fully insert the ball down over the launch tube to seat the ball within the basket safety housing.

Step 8: Select a passing zone, via the play select feature, shown as a button, one of a distance and a play direction to select a desired passing zone (short, medium or long, and left, right, or center), which additionally causes the LED (light indicating diodes) in the passing zone indicia to light indicating the selected passing zone.

Step 9: Actuate the lock button feature to engage the ball and secure against premature launching. This step also closes the internal pressure valve so that pressure can build. If this lock button feature is not engaged, any pump induced pressure will simply leak out.

Step 10A: Once locked, the user uses the hand pump to input an amount of pressure into the pressurized volume relative to an intended distance (short-low (25 psi) pressure, medium-medium (35 psi) pressure, and long-high (45 psi) pressure).

Step 10B: Next, the user presses the "Hike" button and the launching device operates (Step 11) through a pre-recorded sequence of movements based on the selected passing zone (Step 8) which indicates the pivot-rotation member 340 and bayonet member 360 is traversing left/right and indexing up/down while both (i) passing zone lights flash and an audio play ("hike, hike") and several musical notes are announced through the speakers and the motor 364 rotates the retaining locking ring 367 and the game toy (ball) is released in a Step 12.

Step 13: End, and return to Step 7 by installing a further ball on the launch tube of the bayonet housing and repeat for further game play.

As used herein the phrases air pressure, pneumatic pressure, pressure, inflate, fluid pressure or other indicators are interchangeably and descriptively used to indicate a medium of pressurized gas used to operatively impart launching force (to launch) the play item, ball, etc. during a use of the present invention.

As used herein the phrase 'football', 'game ball', 'ball' may be used interchangeably and descriptively to indicate the play item which is launched from the launching device. For example, the 'ball' could be shaped as a recognized American football, a baseball, a rugby-ball, or any other type of play playing item which is operationally and operatively used herein without departing from the scope and spirit of the present invention.

As used herein, a "control board" or "automated controller" comprises an input device for receiving data, an output device for outputting data in tangible form (e.g. gear driver motors for motion and valve release, LED lighting, audio sound generation, depending upon passing zone positions, a permanent memory for storing data as well as computer code, and a microprocessor for executing computer code wherein said computer code resident in said permanent memory will physically cause said microprocessor to read-in data via said input device, process said data within said microprocessor and output said processed data via said output device.

It will be further understood by those of skill in the art that the apparatus and devices and the elements herein, without limitation, and including the sub components such as operational structures, memory systems, control circuits, both electronic and pneumatic communication pathways, and related elements, control elements of all kinds, LED-control and display circuits and display systems and elements, audio-memory circuits and audio-play control and operation circuits, any necessary motor gearing, cams and motor driving elements, motor controls, sensor inputs, sensors, detectors, memory elements, processors and any combinations of these structures etc. as will be understood by those of skill in the art as also being identified as or capable of operating the systems and devices and subcomponents noted herein and structures that accomplish the functions without restrictive language or label requirements since those of skill in the art are well versed in related launching devices, systems, and methods using a pressurized fluid system and engine as well as all operational controls and technologies of related devices and all their sub components, including various circuits and combinations of circuits without departing from the scope and spirit of the present invention.

Although only a few embodiments have been disclosed in detail above, other embodiments are possible, and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

Those of skill would further appreciate that the various illustrative logical blocks, modules, circuits, and algorithm steps described in connection with the embodiments disclosed herein may be implemented as electronic hardware, computer software stored in a memory that is programmed to carry out the operations described in this application, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

A processor may also be implemented as a combination of computing devices, e.g., a combination of a DSP and a microprocessor, a plurality of sensors, memory devices microprocessors, one or more microprocessors in conjunction with a DSP core, or any other such configuration known in the art. These devices may also be used to select values and operations for the steps and for the actions described herein.

The steps of a method or algorithm as described in connection with the embodiments disclosed herein may be embodied directly in hardware, in a software module executed by a processor connected with the hardware and in control thereof (e.g., motor controllers and motor-timing-controllers), or in combinations. A software module stored in a memory may reside in Random Access Memory (RAM), flash memory, Read Only Memory (ROM), Electrically Programmable ROM (EPROM), Electrically Erasable Programmable ROM (EEPROM), or any other form of tangible storage medium that stores tangible, non-transitory computer-based instructions. An exemplary storage medium is coupled to the processor such that the processor can read information from, and operate according to the storage medium instructions controlling the hardware devices as noted herein. In the alternative, the storage medium may be integral to or separate from the processor. The processor and the storage medium may reside in reconfigurable logic of any type.

In one or more exemplary embodiments, the functions described may be implemented in hardware, software, firmware, or any combination thereof.

Computer readable media can be an article comprising a machine-readable non-transitory tangible medium embodying information indicative of instructions that when performed by one or more machines result in computer implemented operations comprising the actions described throughout this specification.

Also, the inventors intend that only those claims which use the words "means for" are intended to be interpreted under 35 USC 112 moreover, no limitations from the specification are intended to be read into any claims, unless those limitations are expressly included in the claims.

Where a specific numerical value is mentioned herein, if anywhere, it should be considered that the value may be increased or decreased by 25%, while still staying within the teachings of the present application, unless some different range is specifically mentioned. Where a specified logical sense is used, the opposite logical sense is also intended to be encompassed to be understood (e.g., retain/release, pressure/exhaust).

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A launching device, for a pneumatic toy, comprising:

a fluid pressure control system with a pneumatic launch engine, comprising;

a rechargeable inflatable compressed air canister in a launchable toy having an open mouth thereof;

said open mouth of said air canister having an outer access ring bounding said open mouth and including at least one inwardly projecting member;

said outer access ring including two opposed outwardly projecting locking members extending away from said open mouth;

an intake manifold of said pneumatic launch engine;

said intake manifold comprising an air outlet for complementally receiving and releasing said open mouth of said compressed air canister during a use;

an external air inlet having a one-way check valve for permitting external air pressurization of said compressed air canister during said use and selectable external air re-pressurization of said compressed air canister during a re-use thereof;

an automated launching control system, comprising;

a receiving bayonet member on said air outlet for slidably and guidably receiving said open mouth of said compressed air canister thereon;

said bayonet member including a central opening for transmission of said external air pressurization into said compressed air canister during said use;

said bayonet member including an outer surface having a guiding spiral groove thereon for slidably and guidably receiving said projecting member and inducing a spiral rotation of said compressed air canister during a launch thereof;

a rotationally movable lock retaining member proximate a base of said receiving bayonet member positioned to receive said outer access ring of said air canister and to rotate between a lock position and an unlock position during said use;

said rotationally movable lock retaining member having two opposed inwardly projecting lugs positioned to engage with said two opposed outwardly projecting locking members on said outer access ring of said air canister when said open mouth is positioned on said receiving bayonet in said lock position for pressurizing said air canister and to disengage with said two opposed outwardly projecting locking members on said outer ring access of said air canister when said rotationally movable lock retaining member is rotated to the unlock position;

a lock retaining and releasing system for operating said rotationally movable lock retaining member between said lock and said unlock position during said use; and a launch direction system with motor control moving said bayonet member through a series of vertical and traversal steps retained in a permanent memory of a control board selected by a user prior to a release of said lock retaining member by said lock retaining and releasing system.

* * * * *